United States Patent [19]

Ando

[11] 4,026,052

[45] May 31, 1977

[54] MULTI-DISK ROTATABLE YEAR CALENDAR

[76] Inventor: Toru Ando, 2-6-12 Matsugaoka, Chigasaki, Kanagawa, Japan

[22] Filed: Mar. 22, 1976

[21] Appl. No.: 669,399

[30] Foreign Application Priority Data

Sept. 25, 1975 Japan ..... 50-131279[U]
Mar. 27, 1975 Japan ..... 50-41064[U]

[52] U.S. Cl. ..... 40/115; 35/74; 40/113

[51] Int. Cl.[2] ..... G09D 3/08

[58] Field of Search ..... 40/114, 115, 113, 70 R; 35/74

[56] References Cited

UNITED STATES PATENTS 900,310 10/1908 Proctor ..... 40/115

*Primary Examiner*—E. H. Eickholt
*Attorney, Agent, or Firm*—Martin A. Farber

[57] ABSTRACT

A calendar comprising a date disk and a week disk which are rotatably coupled with each other. The date disk has date figures and the week disk has week indicating letters. The calendar has further month indicating letters and formations for bringing unnecessary month indicating letters into the invisible state. The date disk and the week disk may be corresponded according to the selected month by relatively rotating both disks and selecting the month indicating letter.

5 Claims, 3 Drawing Figures

MULTI-DISK ROTATABLE YEAR CALENDAR

The present invention relates to a calendar, and more particularly to a wall calendar or table calendar or to a small-sized calendar which is suitable to be attached on the watchband or on the dial of telephone.

Although there has been a calendar printed on a thin aluminum plate to be attached on the watchband, it is inconvenient and uneconomical because the calendar shows only one month and the old calendar should be replaced by new one.

The present invention has its object to provide a small-sized and economical calendar which may be arranged to show the date and week of any desired month through a year.

Other objects and advantages of the present invention will be apparent from the following description with reference to the accompanying drawing, in which.

Figure 1:
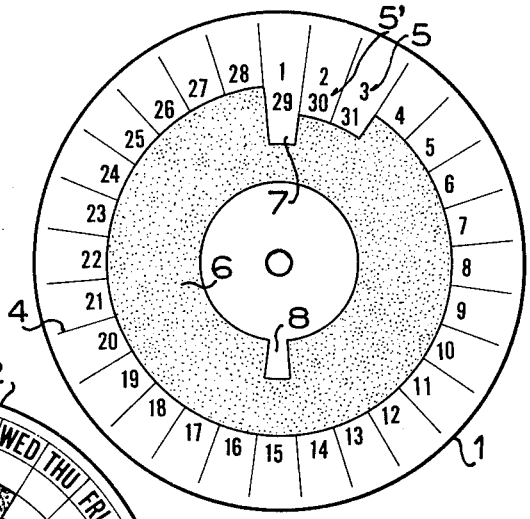
FIG. 1 is a plane view of date disk.

Referring to the drawing, the calendar of the present invention comprises a data disk 1 and a week disk 2. The week disk 2 is coaxially superimposed on the date disk 1 and both disks are rotatably coupled each other at the center by an eyelet 3. It will be understood that the week disk 2 may be coupled to the date disk 1 by any other suitable device such as cover ring.

The date disk 1 is made of paper or synthetic resin sheet. On the date disk 1, radial lines 4 are drawn for dividing the disk into 28 columns 5 in which the dates of 1st to 28th are printed. Date columns 5' define an annular band segment in which the dates of 29th to 31st are printed are located completely radially inside of the annular band of indicia of the columns 5 of dates of 1st to 3rd.

Except the date columns 5 and 5', and a month column 7 and a holiday column 8, the central part 6 of the disk is coloured, for example, by red. The month column 7 is positioned inside of the 1st and 29th day of date columns 5 and 5' and the holiday column 8 is positioned in the opposite side of 1st day of date column 5 and nearer to the center of the date disk 1 than the month column 7.

Figure 2:
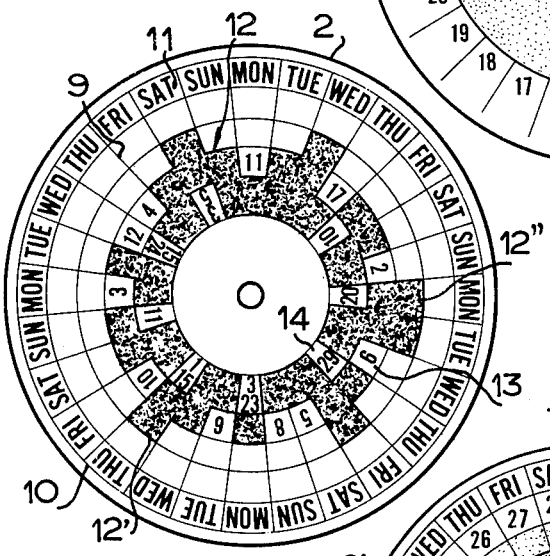
FIG. 2 is a plane view of week disk.

The week disk 2 is made of transparent synthetic resin and has same size as the date disk 1. As shown in FIG. 2, many radial lines 9 and coaxial circles or annular bands or regions 10 are drawn on the disk 2, so that outer part is divided into equal 28 columns 11 for 4 weeks along the rim of week disk 2. The radial lines 9 are adapted to align with the radial lines 4 of the date disk 1 so that the week columns 11 may be placed outside the date columns 5. Thus, day of the week column 11 may be correspond with day of the date column 5 or 5' by relative rotation of disks 1 and 2.

The week disk has opaque or non-transparent cover portions 12 which are coloured, for example, by black and which may selectively cover the date columns 5'. The week disk has further month columns 13 and holiday columns 14. The month columns 13 indicate 12 months and may correspond to the month column 7 of the date disk 1. The holiday columns 14 are to show national holidays and are disposed to correspond to the holiday column 8.

Because the columns 7 and 8 are blank defining window delineation or viewing areas, a figure of only one month column 13 which corresponds to the column 7 and figure of the holiday column 14 which also corresponds to the column 8 are capable of being seen.

The end-of-month-day opaque cover area portion 12 comprises cover sections 12' and 12'' which angularly spaced apart corresponding to particular months and are formed in an annular region spaced from the center of the disk equal to that of the annular band segment 5' from the center of its disk, and which cover the date columns 5' selectively. One of the cover area sections 12' and 12'' covers the 31st day of the date column 5' or 30th and 31st day of the date columns 5' (and 29th day in the common year) in the even months which contain 29 days or 30 days (or 28 days in the common year) (the drawing shows a leap year). In the odd months which contain 31 days, no date columns 5' are covered by any of the end-of-month-day cover area sections 12' and 12''.

Each of the month columns 13 and each of the holiday columns 14 are so disposed that when the desired month of the column 13 is aligned corresponding to the month column window 7, the day of the week of the week column 11 will correspond to the date of the date columns 5 and 5' and the holiday date(s) of the month will be seen corresponding to that month in the columns or window delineation area 8. Further the opaque cover portion 12 is adapted to cover unnecessary months according to the selected month.

Figure 3:
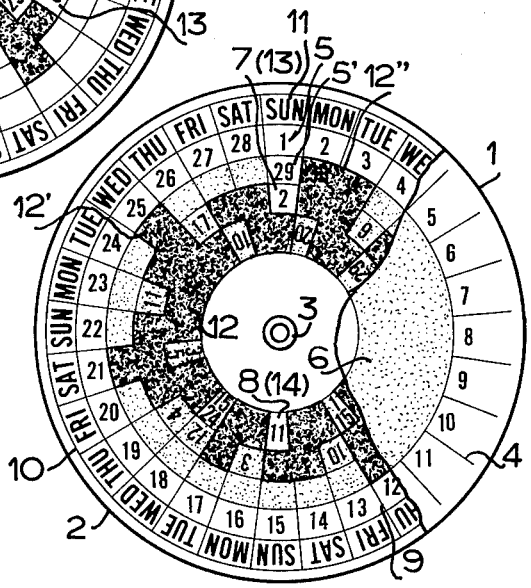
FIG. 3 is a plane view of a calendar according to the present invention.

In operation, the date disk 1 and the week disk are relatively rotated to correspond a desired month to the month column 7. FIG. 3 shows the calendar adjusted to February. The column of Sunday of the week columns window delineation area 11 is positioned just outside of the 1st day of the date column 5. In this way, it will be seen that the 1st day of February is Sunday. Also in a leap year, because February is an odd month of 29 days, the end-of-month-day non-transparent or opaque cover area 12'' covers the 30th and 31st indicia of the annular date indicia band segment 5'.

It will be observed that the figures of the twelve months and holidays may be printed on the date disk and window delineation areas through which one of the months or holidays appears can be provided in the week disk instead of the month column 7 and holiday column 8.

From the foregoing, it will be understood that the present invention provides a calendar which is handy to see dates, days of the week, and month through one year. Also by making the calendar in smaller size, and by using a simple clasp, the calendar may be attached on the watchband. The calendar also can be fixed on the central portion of the telephone dial. In accordance with the custom of the country, the holiday column 8 and holiday columns 14 can be omitted to make the center blank space to present a space for commercial advertisement.

What is claimed is:

1. A calendar for a particular one-year, comprising a circular date disk having a center, a circular week disk having a center and coaxially superimposed on said date disk and rotatably coupled therewith, said date disc having thereon date indicia comprising numerals 1 to 28, 29, 30, 31, respectively and consecutively, said indicia 1–28, inclusively, being circularly arranged in a first annular band defining a first radial distance range from said center of said date disc, said indicia of 29, 30, 31 being disposed in a second annular band segment spaced radially and inwardly of the indicia 1, 2, 3, respectively, said second annular band segment being completely disposed closer to said center than that of the entire of said first radial distance range of said first annular band from said center, weekday indicia letters for 4 weeks disposed circularly on said week disk arranged to radially correspond with said date indicia on said date disk, one of said disks being formed with a window delineation area spaced at another radial distance from said center of said one disk, the other of said disks having 12 month indicia means annularly disposed and spaced angularly from one another and at a radial distance from said center of said other disk equal to said another radial distance and arranged for corresponding said date indicia with said weekday indicia letters for the particular one-year and for any particular month, when one of the month indicia means corresponding to said particular month is aligned with said window delineation area, said week disk being further formed with a plurality of end-of-month-day opaque area means arranged in predetermined angular positions corresponding to and relative to said month indicia means for bringing only certain of said date indicia 29, 30, 31 into visible condition and for blocking out remaining of the latter corresponding to those of said particular month then aligned in said window delineation area, said plurality of end-of-month-day opaque area means being disposed at spaced angular positions defining another annular band segment, the latter disposed at a radial distance from the center of said week disk equal to that of said second annular band segment of the date indicia 29, 30, 31 from said center of said date disk.

2. The calendar in accordance with claim 1 wherein said month indicia means are provided on said week disk, said date disk being formed with an annular colored portion at said another radial distance interrupted at one portion defining said window delineation area.

3. The calander in accordance with claim 1, wherein said month indicia means are provided on said date disk, and said window delineation area is formed on said week disk.

4. The calendar in accordance with claim 1, wherein said other of said disks has a plurality of monthly holiday indicia dates uniformly angularly oriented relative to a corresponding of said 12 month indicia means, respectively, all of which are oriented in an annular region positioned radially inwardly with respect to said another radial distance, said one of said disks being formed with another window delineation area disposed spaced from said center of said one disk equal to the distance of said annular region from the center of said other disk, and angularly oriented on said one disk relative to said first-mentioned window delineation area equal to the uniform angular orientation of the holiday indicia dates from said month indicia means corresponding thereto.

5. A calendar in accordance with claim 1 in which said week disk is made of transparent material.

* * * * *